United States Patent [19]

Differ

[11] Patent Number: 4,854,458

[45] Date of Patent: Aug. 8, 1989

[54] RECLOSABLE TAMPER-PROOF SPECIMEN BOTTLE

[76] Inventor: Dennis J. Differ, Rte. 6, Box 374, Fort Payne, Ala. 35967

[21] Appl. No.: 238,623

[22] Filed: Aug. 30, 1988

[51] Int. Cl.[4] ..... B65D 41/48

[52] U.S. Cl. ..... 215/253

[58] Field of Search ..... 215/253, 250, 252; 220/266, 265, 276

[56] References Cited

U.S. PATENT DOCUMENTS 2,930,063 3/1960 Stull ..... 215/253 X

FOREIGN PATENT DOCUMENTS 2417442 9/1979 France ..... 215/253

*Primary Examiner*—Donald F. Norton

*Attorney, Agent, or Firm*—Alan Ruderman

[57] ABSTRACT

A closure and container for specimens or the like have interlockable detents which connect together when the closure is forcibly disposed in closing relationship with the container. The upper portion of the container has a dome portion and the closure member has a cooperating dome portion, the detents being formed in the respective dome portions. The detents have surfaces which permit a sealing connection but prevent the release of the closure from the container. The closure member has a neck including a frangible section which must be broken in order to gain entry into the container once closed by the closure member. The closure member also has a cap above the frangible section having screw threads about the exterior periphery which threadedly connect to internal threads within the neck of the closure member adjacent the frangible section so that the container may be reclosed for further use.

11 Claims, 2 Drawing Sheets

RECLOSABLE TAMPER-PROOF SPECIMEN BOTTLE

BACKGROUND OF THE INVENTION

This invention relates to a closure system for a sampling bottle and more particularly to a tamper-proof closure for a bottle in which liquid specimens are contained, the closure being locked to the bottle after it is filled and preventing contamination or tampering with the contents thereof during shipping and storage and having a break-away portion permitting opening at a testing laboratory or the like while providing reclosing capability of the break-away portion with the remainder of the closure.

A substantial number of applications exist for a container closure system preventing tampering with the contents of the container. For example, when testing persons for drug use or the like, a urine specimen is diagnosed to determine whether the person has been a recent user of various controlled substances. In the past, there have been a number of instances where a sample has been tampered with, or even replaced, between the time of sampling and the receipt of a specimen by a testing laboratory. Other fluids, such as sterile liquids, also typically are shipped and stored prior to use and it is vital that such liquids be maintained in a container in its original sterile condition until used. Examples of a substantial number of liquids required to be maintained in their initial conditions may be readily envisioned. Thus, it is highly desirable to provide a closure which seals the container to prevent contamination or the like of such liquids.

Additionally, to ensure that the interior of the container has not been violated, the container should have some means for evidencing any tampering with the closure seal.

Numerous proposals have been made in the prior art toward solutions of these problems. For example, a number of closures having mechanical locking means have been proposed wherein entry to the contents of the container is accomplished by cutting or puncturing the closure. One such proposal is illustrated in Golde U.S. Pat. No. 3,074,580. In Karsten et al U.S. Pat. No. 4,616,760 it was proposed that a closure member be bonded to the container by an adhesive layer or the like, the container being accessed by breaking the bond. In Bertaud et al U.S. Pat. No. 4,494,663 a screw type closure member is threaded onto the neck of the container and a frangible section is provided for entry into the container when a tab is pulled to fracture the weakened portions of the frangible section. Constructions similar to this latter arrangement are disclosed in Choksi U.S. Pat. No. 3,974,008; Bellamy et al U.S. Pat. No. 4,181,232 and Ganz et al U.S. Pat. No. 4,236,646. Examples of other proposals are illustrated in Martha U.S. Pat. No. 4,545,497; Damsel et al U.S. Pat. No. 2,069,005 and Whitney U.S. Pat. No. 2,030,617.

In addition to a container having a secured closure that would prevent tampering with the contents and would evidence any tampering, it is desirable for the closure to have reclosing capability. For example, after the container having a liquid to be tested is unsealed at a testing laboratory or the like, it is desirable that a portion of the liquid remain in the container for subsequent use should the initial test be fouled or inconclusive. Thus, although the container should be initially sealed and have means for indicating any tampering therewith, it should also include reclosing capability after the initial seal is broken by authorized personel to prevent contamination should the remainder of the contents be required for further use.

SUMMARY OF THE INVENTION

Consequently, it is a primary object of the present invention to provide a combination closure and container which securely lock together to seal the container, the closure having frangible means which must be broken for entry into the container.

It is another object of the present invention to provide a combination closure and container wherein the closure may be secured to the container after the container has been filled, the closure and container having cooperating means preventing removal of the closure from the container, and the closure having frangible means for removal of the contents from the container, the frangible means providing evidence of a violation of the container's interior.

It is a further object of the present invention to provide a combination closure and container which securely lock together to seal the container, the closure having frangible means which must be broken for entry into the container, and the closure having reclosing means usable after the closure has been broken by authorized personel.

Accordingly, the present invention provides a container for specimens or the like and a cooperating closure, the container and closure having interlockable cam detents which connect together when the closure is forcibly disposed in closing relationship with the container. The interlocking detents have surfaces which permit a sealing connection but prevent release of the closure from the container. The closure member has a neck including a frangible section which must be broken in order to gain entry into the container once the closure member has been connected thereto. The frangible section provides a visual indication of the integrity of the contents since tampering therewith may be clearly seen. Additionally, the closure member has external connecting means spaced from the frangible section remote from the container, the external connecting means being adapted to cooperate with internal connecting means within the neck adjacent the frangible section so that the container may be reclosed for further use if necessary.

In the preferred form of the invention, the container has an upper dome portion including an annular recessed step in the exterior wall of the dome portion, the pit or inner most portion of the step extending outwardly at an angular incline to form a sloped cam surface, and the closure, which is hollow, has a similarly shaped dome portion including a cooperating protuberance extending from the interior wall thereof, the protuberance being received within the recessed step when the closure member is pushed onto the domed portion of the container. The cooperating relationship of the step and the protuberance prevent removal of the closure once it locks onto the container. The neck of the closure member extends from the dome portion thereof away from the container and has a frangible or weakened annular wall section which may be broken-away by twisting or bending of the closure member above the frangible section to gain access to the contents of the sealed container. Once the frangible section is broken, there is a clear indication that the interior of the container may have been violated unless the breakage occurs at an authorized location. Ears may be disposed on the closure member to aid in the breaking thereof.

The upper or cap portion of the closure member above the frangible section includes external threads which cooperate with internal threads in the closure member below the frangible section for reclosing the container so that once the frangible section is broken by an authorized person, if the contents are necessary for further use, the cap portion may be reattached to the remainder of the closure member by threading it therein.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
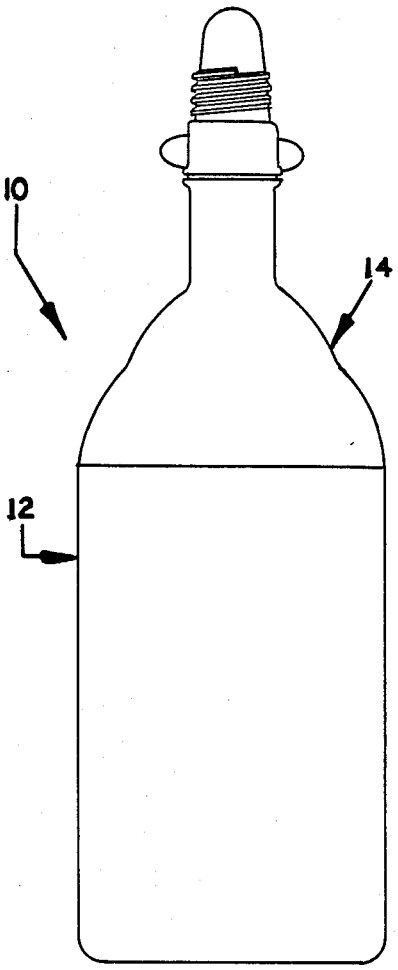
FIG. 1 is an elevational view of an assembled container and closure constructed in accordance with the principles of the present invention.
Figure 2:
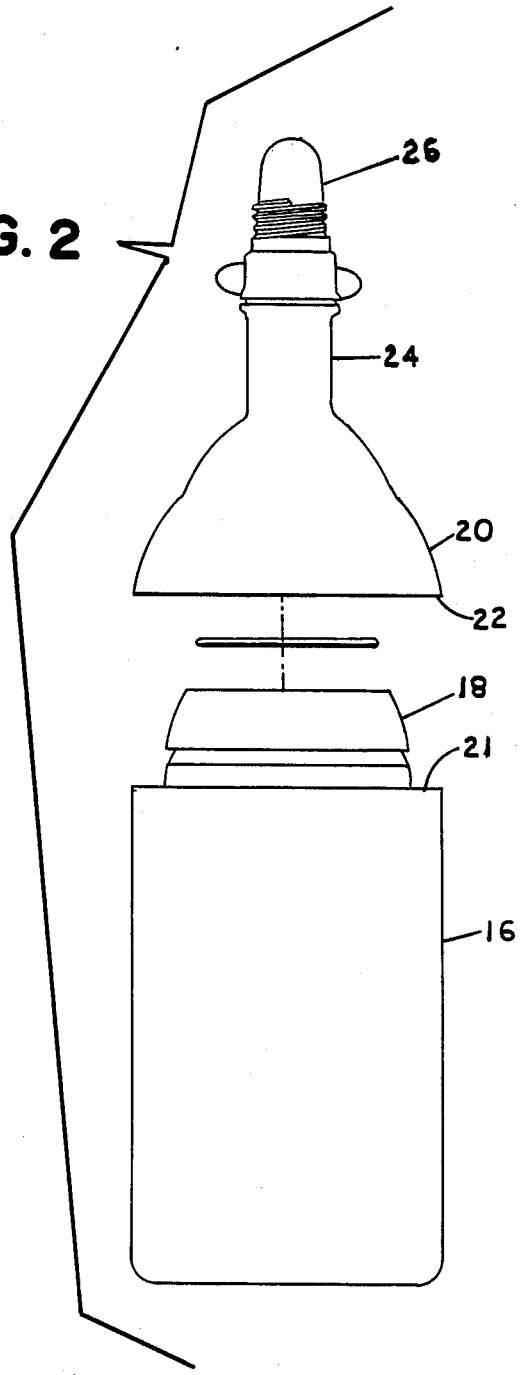
FIG. 2 is a disassembled view thereof.
Figure 3:
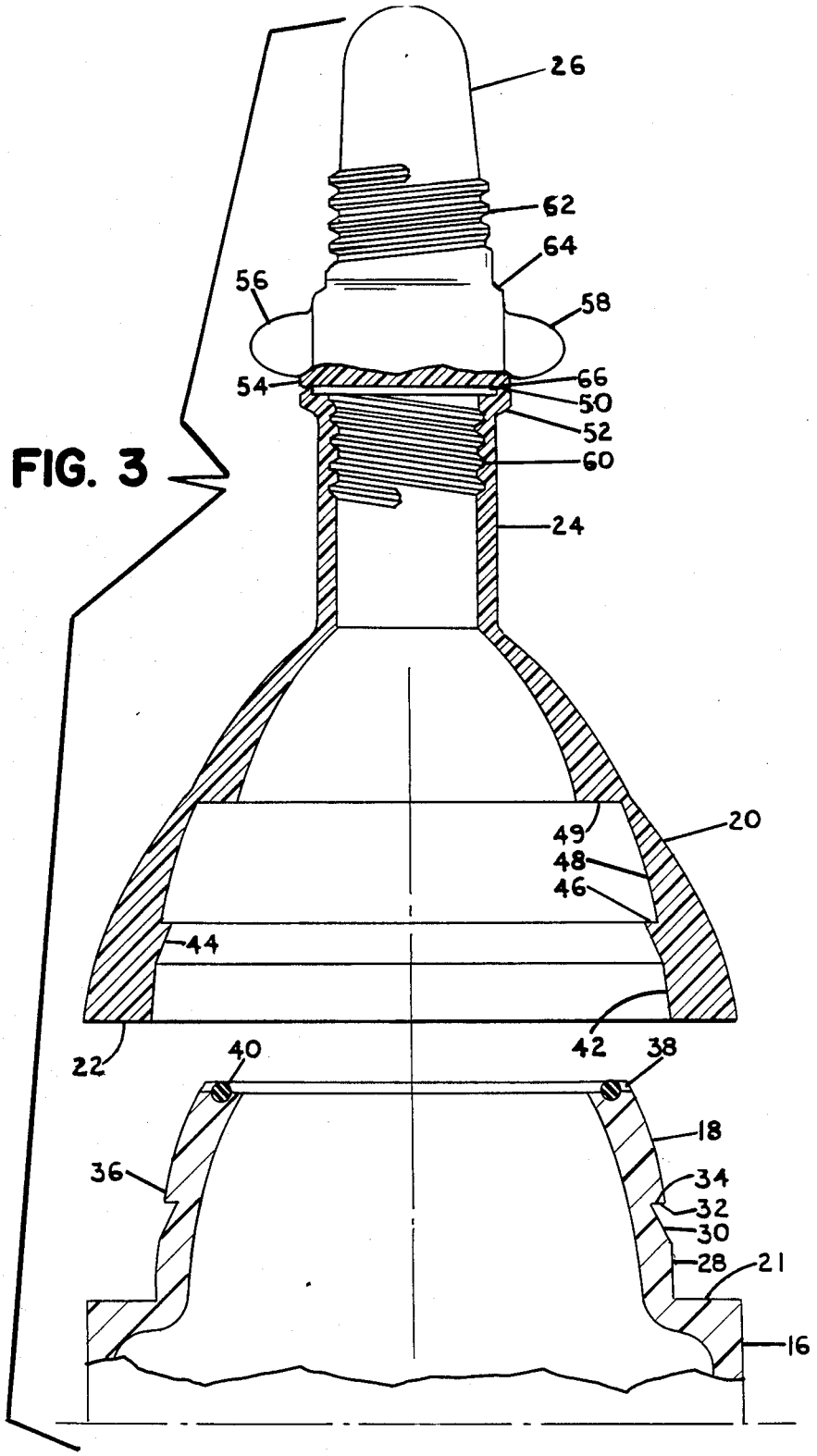
FIG. 3 is a fragmentary cross sectional view of the closure and the dome portion of the container at a greatly enlarged scale relative to FIGS. 1 and 2.

Referring now to the drawings, a combination container and closure 10 includes the container 12 and closure member 14 both of which are constructed from synthetic plastic material by molding or the like. The container 12 may have a hollow cylindrical body 16 and includes a domed upper portion 18, while the closure 14 has a cooperating domed lower portion 20 for receiving the dome portion 18 of the container. The container 12 has an annular shoulder 21 at the interface between the cylindrical portion 16 and the domed portion 18 thereby forming the seat for the lower rim 22 of the closure member. In addition, the closure member 14 has an elongated neck 24 extending from the domed lower portion 20 and terminating at the top in a cap 26, the purposes of which will hereinafter become clear.

The exterior of the domed portion 18 of the container includes an annular surface 28 extending upwardly from the shoulder 21 and terminating in an inwardly and upwardly inclined ramp 30. The ramp extends to an innermost annular edge 32 forming the pit of the ramp and at which a radial step forming a detent 34 is formed in the dome extending from the pit 32 to the outer surface of the domed portion 18. From the outer edge of the step 34 the dome 18 has a slight downwardly inclined annular surface 36 adjacent the step and intermediate the step and the upper rim 38. The rim 38 includes a groove within which a seal in the form of an "O" ring 40 is disposed.

The domed portion 20 of the closure member 14 has an internal surface adopted to cooperatively receive and mate with the external surface of the dome portion 18 of the container so as to lock therewith. Thus, the interior of the dome portion 20 is the mirror image of the container dome portion 18 and includes an annular surface 42 extending upwardly from the rim 22 to an inclined ramp 44, the ramp 44 matching the surface of the ramp 30. A radially inwardly extending protuberance is formed by a radial step or shelf forming another detent 46 extending inwardly from the surface of the dome 20 at the upper end of the ramp 44, i.e., the interior surface of the dome steps outwardly from the axis of the closure member at the upper end of the ramp 44 to an annular surface 48, the surface 48 being the mirror image of the surface 36 of the container. The protuberance formed by the detent 46 is the mirror image of the detent 34 on the dome 18 of the container and when the closure member is positioned onto the dome of the container, the ramp 44 slides along the upper portion of the surface 36 until just above the detent 34. At this point the diameter of the upper portion of the ramp 44 at the protuberance is slightly greater than the diameter of the lower portion of the surface 36. Thereafter, the application of a downward force on the closure member compresses the plastic material of both the ramp 44 and the surface 36 until the protuberance formed by the detent step 46 slips past the edge of the surface 36 at the interface with the detent step 34 and engages the pit 32 of the ramp 30. When this occurs the protuberance formed by the detent 46 is disposed beneath and in abutting relationship with the detent 34 and the closure is locked onto the container. The closure member cannot be removed from the container because of this interlocking relationship of the detents 34 and 46.

Accordingly, after the specimen to be tested is poured within the container and is to be sent to a testing facility, or the like, the closure member is locked onto the container, with the seal 40 acting against a ledge 49 formed within the closure member above the surface 48 so as to preclude leakage of the contents. Any tampering with the specimen requires a breaking of the closure member which is readily visable.

In order to open the container at the authorized location, the neck portion 24 of the closure member includes a weakened or frangible wall section such as illustrated at 50, the frangible section merely being a readily breakable thin wall formed between thicker wall portions 52, 54 of the closure member. The cap portion 26 is disposed above the frangible section 50, and preferably has a pair of ears 56, 58 so as to aid in breaking-away the cap 26 from the neck 24 at the frangible section 50. Once the cap is broken-away from the neck, the contents of the container are readily accessible.

In order to reclose the container in the event subsequent use of the specimen is required, the neck 24 is formed with internal threads 60 extending from the frangible section 50 downwardly within the neck, while the cap 26 has external matching threads formed above the ears 56, 58. The upper portion of the cap above the threads 62 has a smaller diameter than the diameter of the neck 24 in the threaded portion so that the cap may be inserted into the neck at the broken-away section and the threads 60 may threadedly receive the threads 62 to secure the cap to the neck, the cap being inverted relatively to its position as illustrated in the drawings. The cap 26 above the ears 56, 58 has a ledge 64 of a size for seating on and sealing with the inner surface 66 at the top of the frangible section 50 when the cap is threaded into the neck. Thus, the container may be reclosed by reconnecting the cap 26 to the neck 24, albeit in inverted relationship, for subsequent use of the contents.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A tamper-proof closure system for a fluid sampling container or the like, said system comprising an annular open dome formed at the upper end of said container, said dome having interior and exterior peripheral surfaces, a first annular detent disposed about the exterior peripheral surface of said dome, a closure member comprising a lower hollow dome shaped portion including a peripheral rim adapted for disposition about the dome of said container and an interior wall surface having substantially the same configuration as the exterior surface of the dome of said container for abutting therewith when said closure member is disposed on said container, a second annular detent disposed about said interior wall surface, said second annular detent being a mirror image of said first annular detent for interlocking therewith when the closure member is forcibly urged into abutment with the dome of said container to seal said container, said closure member having an elongated hollow neck extending from the dome of said closure member, a cap, frangible wall means connecting said cap to said neck for permitting breaking-away of said cap from said neck to remove said fluid from said container through said neck subsequent to closing of said container, said neck adjacent said frangible wall means having first connecting means disposed about the interior periphery thereof, and said cap having second connecting means disposed about the exterior periphery thereof, said second connecting means being receivable within said neck subsequent to breaking-away of said cap therefrom for cooperating with said first connecting means to reclose said container.

2. A tamper-proof closure system as recited in claim 1, wherein said first detent comprises a radial step indented into the exterior surface of the dome of said container and an inclined ramp extending outwardly and downwardly from the radially innermost portion of said step, and said second detent comprises a protuberance extending from the interior wall surface of the dome of said closure member, said protuberance having a diameter greater than the diameter of the periphery of the dome of said container at the location adjacent to where the step is indented, such that the protuberance is receivable within the step and is thereafter precluded from escaping.

3. A tamper-proof closure system as recited in claim 1, wherein said first and second connecting means comprises screw threads.

4. A tamper-proof closure system as recited in claim 1, wherein said cap includes ears disposed thereon for twisting said cap to break said frangible wall means, said ears being disposed intermediate said frangible wall means and said second connecting means.

5. A tamper-proof closure system as recited in claim 4, wherein said first and second connecting means comprises screw threads.

6. A tamper-proof closure system as recited in claim 5, wherein said first detent comprises a radial step indented into the exterior surface of the dome of said container and an inclined ramp extending outwardly and downwardly from the radially innermost portion of said step, and said second detent comprises a protuberance extending from the interior wall surface of the dome of said closure member, said protuberance having a diameter greater than the diameter of the periphery of the dome of said container at the location adjacent to where the step is indented, such that the protuberance is receivable within the step and is thereafter precluded from escaping.

7. A tamper-proof closure system as recited in claim 1, wherein said container includes a shoulder extending radially outwardly from the lower portion of the dome thereof, and the dome of said closure member includes a peripheral rim positionable on said shoulder when said closure member is closed about the dome of said container.

8. A tamper-proof closure system as recited in claim 7, wherein the interior wall of the dome of said closure member includes a radial ledge disposed intermediate said second detent and said neck for disposition upon the periphery of the dome of said container when said rim is positioned on said shoulder, and seal means disposed intermediate said ledge and the upper periphery of the dome of said container when said closure member is closed about the dome of said container.

9. A tamper-proof closure system as recited in claim 8, wherein said first detent comprises a radial step indented into the exterior surface of the dome of said container and an inclined ramp extending outwardly and downwardly from the radially innermost portion of said step, and said second detent comprises a protuberance extending from the interior wall surface of the dome of said closure member, said protuberance having a diameter greater than the diameter of the periphery of the dome of said container at the location adjacent to where the step is indented, such that the protuberance is receivable within the step and is thereafter precluded from escaping.

10. A tamper-proof closure system as recited in claim 9, wherein said cap includes ears disposed thereon for twisting said cap to break said frangible wall means, said ears being disposed intermediate said frangible wall means and said second connecting means.

11. A tamper-proof closure system as recited in claim 10, wherein said first and second connecting means comprises screw threads.

* * * * *